United States Patent [19]

Archer et al.

[11] 4,412,910

[45] Nov. 1, 1983

[54] RECOVERY OF FUEL FROM OIL SHALE

[75] Inventors: David H. Archer, Ross Township, Allegheny County; M. Mushtaq Ahmed, Pittsburgh, both of Pa.

[73] Assignee: Westinghouse Electric Corp., Pittsburgh, Pa.

[21] Appl. No.: 313,447

[22] Filed: Oct. 21, 1981

[51] Int. Cl.[3] ..... C10G 1/00; C10B 53/06; C10B 49/10

[52] U.S. Cl. ..... 208/11 R; 208/8 R

[58] Field of Search ..... 208/11 R, 8 R; 202/109, 202/116, 120, 121

[56] References Cited

U.S. PATENT DOCUMENTS

| | | | |
|---|---|---|---|
| 2,626,234 | 1/1953 | Barr et al. | 208/11 R |
| 2,689,787 | 9/1954 | Ogorzaly | 208/11 R |
| 2,697,688 | 12/1954 | Nicolai | 208/11 R |
| 3,703,052 | 11/1972 | Linden | 208/11 R X |
| 3,847,563 | 11/1974 | Archer et al. | 48/77 |
| 3,891,403 | 6/1975 | Weil et al. | 48/197 R |
| 3,922,215 | 11/1975 | Linden | 208/11 R |
| 3,929,615 | 12/1975 | Linden et al. | 208/11 R |
| 4,003,821 | 1/1977 | Weil | 208/11 R |
| 4,010,092 | 3/1977 | Deering | 208/11 R |
| 4,043,897 | 8/1977 | Deering | 208/11 R |
| 4,083,770 | 4/1978 | Deering | 208/11 R |
| 4,105,502 | 8/1978 | Choi | 208/11 R |
| 4,118,201 | 10/1978 | Yan | 208/8 R X |
| 4,125,453 | 11/1978 | Tamm et al. | 208/11 R |
| 4,148,710 | 4/1979 | Burton | 208/11 R |
| 4,160,720 | 7/1979 | Seader et al. | 208/11 R |
| 4,324,640 | 4/1982 | Durai-Swamy | 208/11 R X |

*Primary Examiner*—Delbert E. Gantz
*Assistant Examiner*—Glenn Caldarola
*Attorney, Agent, or Firm*—Z. L. Dermer

[57] ABSTRACT

Raw shale is supplied to a pyrolyzer where it is pyrolyzed by fuel gas and hot spent shale derived from a gasifier. Typically, the raw shale is Eastern U.S. shale and the pyrolyzer includes a fluidized bed. The pyrolyzed shale having given up its oil and volatile hydrocarbons, rises to the top of the fluidized bed of raw shale where it is transferred to the gasifier. Oxygen and steam are supplied to the gasifier. This composite gas reacts with the carbon of the pyrolyzed shale in a fluidized bed to produce synthesis or fuel gas. The oxygen is supplied in such quantities as not to react completely with the carbon in the pyrolyzed shale. The steam reacts with the excess of carbon. Predominantly hydrogen and carbon monoxide are produced; in addition there is a smaller quantity of carbon dioxide and methane. This hot fuel gas is transferred to the pyrolyzer. In addition, hot spent shale is transferred to the pyrolyzer. The hot fuel gas fluidizes the raw shale in the pyrolyzer. The hot gas and the hot spent shale heat the raw shale separating the shale oil and product gas including volatile hydrocarbons. The oil is condensed and collected, the fuel gas is collected for utilization in the above process and also for other purposes.

10 Claims, 3 Drawing Figures

RECOVERY OF FUEL FROM OIL SHALE

BACKGROUND OF THE INVENTION

This invention relates to the recovery of fuel from oil shale. It has particular application to the processing of oil shale mined in Eastern United States; i.e., states like Kentucky and others predominately east of the Mississippi River. It is emphasized that, while this invention is uniquely applicable to Eastern shale, it is not intended that this invention should be in any way restricted to practice only with Eastern shale. To the extent that the teachings presented here are applicable to oil shales from other areas or of other types than those from Eastern United States, such application is within the scope of this invention.

The prior art teaching deals predominantly with oil shale derived from Western United States. Burton U.S. Pat. No. 4,148,710 typifies this prior art teaching. Burton combines pyrolysis and combustion to derive fuel from the shale. The raw shale is pyrolyzed in a fluidized bed by heat derived from gases resulting from the combustion or oxidation of the residual carbon from the spent shale. This spent shale is also maintained in a fluidized bed during combustion.

The following Table I presents an analysis of oil shale from Sunbury, Kentucky:

TABLE I

| Sunbury Shale Analysis | Westinghouse Electric Corporation* | IGT** | IMMR*** |
|---|---|---|---|
| Total Carbon, wt. % | 17.89 ± 0.84 | 14.71 | 13.63 |
| Hydrogen | 2.08 ± 0.05 | 1.74 | 1.83 |
| Nitrogen | 0.63 ± 0.01 | 0.56 | 0.61 |
| Sulfur | 2.48 ± 0.19 | 3.25 | 3.16 |
| Oxygen (by difference) | 2.07 ± 1.12 | 2.66 | |
| Ash | 74.85 ± 0.29 | 77.05 | |
| | 100.00 | 100.00 | |
| H/C Atomic Ratio | 1.40 ± 0.06 | 1.41 | 1.61 |

*Average of six analyses
**Institute of Gas Technology
***Institute of Mining & Mineral Research The divergence in carbon content between the Westinghouse analysis and the IGT and IMMR analyses could to a large extent result from differences in the material analyzed.

The carbon content in the above table, which is between 13.63% and 18.73% according to Table I, is the total content of carbon in the shale. The total carbonaceous material is called the kerogen. The kerogen includes the oil and vaporous hydrocarbon products and the residual carbon in the shale. The total content of carbon in Western U.S. shale is about the same. The difference between Eastern and Western shale resides in the relative proportions of oil-shale organic carbon recovered as liquid and gaseous fuels. While in Western shales pyrolysis recovers 70–90% of the kerogen as liquid and/or gaseous fuels leaving 30–10% behind as residual carbon, in Eastern shales pyrolysis recovers 30–60% of the kerogen as liquid and gaseous fuels leaving 60–40% as residual carbon. Pyrolysis and combustion for Eastern shales results in a low yield of fuels and either an excess of heat from combustion or a loss of residual carbon in the spent shale. The following Table II shows how the components of the kerogen are distributed in the products of a pyrolysis of Eastern shale:

TABLE II

| Sunbury Oil Shale Processing Results Elemental Balances | | | | | | |
|---|---|---|---|---|---|---|
| Material Balance (Wt. % Distribution) | | Westinghouse Studies-Laboratory Scale | | | | |
| Carbon: | Shale Oil | 31.0 | 30.6 | 26.7 | 29.7 | 33.6 |
| | Spent Shale | NA | 60.9 | 58.8 | 55.4 | 40.2 |
| | Product Gas** | NA | 1.1 | 2.7 | 3.3 | NA |
| | Unaccounted | 69.0 | 7.4 | 11.8 | 11.6 | 26.2 |
| Hydrogen: | Shale Oil | 28.6 | 28.0 | 23.8 | 26.8 | 31.9 |
| | Spent Shale | NA | 32.3 | 40.2 | 23.3 | 20.5 |
| | Product Gas** | NA | 4.5 | 4.4 | 8.4 | NA |
| | Unaccounted | 61.4 | 35.2 | 31.6 | 41.5 | 47.6 |
| Nitrogen: | Shale Oil | 18.4 | 19.7 | 17.3 | 20.1 | 25.4 |
| | Spent Shale | NA | 70.1 | 69.7 | 64.6 | 47.2 |
| | Product Gas** | NA | NA | NA | NA | NA |
| | Unaccounted | 81.6 | 10.1 | 13.0 | 15.3 | 27.4 |
| Sulfur: | Shale Oil | 4.8 | 5.7 | 4.6 | 5.6 | 5.2 |
| | Spent Shale | NA | 75.4 | 55.7 | 62.3 | 55.2 |
| | Product Gas** | NA | NA | NA | NA | NA |
| | Unaccounted | 95.2 | 18.9 | 39.7 | 32.1 | 39.6 |
| Ash: | Spent Shale | NA | 99.2 | 100.7 | 100.3 | 99.0 |
| | Unaccounted | — | 0.8 | −0.7 | −0.3 | 1.0 |

*Unaccounted Depends on Products Collection and Analytical Precisions
**In Westinghouse Studies the Gas Released is not Analyzed for $C_2$ + Compounds, $H_2O$, $H_2S$ and $NH_3$ Which can be Present in the Gas The thrust of Burton's teaching is that sufficient oxygen is supplied to burn completely the residual carbon in the spent shale and/or a portion of the fuel products. Burton implies that the heat derived in this way may not be sufficient, as it suggests adding external heat. Attempts to recover liquid and gaseous fuel from Eastern shale by the practice taught by Burton and other like prior art has proven uneconomical. From a social standpoint, it is highly inadvisable to abandon the Eastern shale. It is estimated that Eastern shales primarily in Kentucky, Ohio, Tennessee, and Indiana hold some 3 trillion barrels including 400 billion barrels in rock which contains 20–25 gal/ton and which can be surface mined. The development of Eastern shales is facilitated by an available supply of water and the presence of workers and a social infrastructure.

It is an object of this invention to overcome the disadvantages and drawbacks of the prior art and to provide an economical process for recovering fuel from Eastern shale. It is also an object of this invention to provide apparatus for practicing this process.

SUMMARY OF THE INVENTION

In accordance with this invention, the recovery of oil from Eastern shale is rendered economically comparable to the recovery of oil from Western shale by converting the excess residual carbon in the Eastern shale into useful gaseous fuel. In the practice of this invention liquid and gaseous fuel is derived from a shale by treating the shale in a pyrolyzer and a gasifier. The expression "pyrolyzed shale" as used in this application should be distinguished from the expression "spent shale". Pyrolyzed shale is the shale in the form which it has just after it leaves a pyrolyzer. Pyrolyzed shale contains residual carbon. Spent shale is substantially free of carbon. It is the shale which leaves the gasifier after gasification. The excess residual carbon is the carbon exceeding that needed to heat the shale to the temperature at which the oil and gaseous hydrocarbons are released. The object of this invention is achieved by reacting the pyrolyzed shale both with oxygen and steam. The supply of oxygen in the practice of this invention is limited to that required to oxidize sufficient residual carbon to produce the heat necessary to meet process requirements for pyrolysis and gasification. The steam reacts with the pyrolyzed shale in the gasifier to produce fuel gas. In a limited oxygen atmosphere, the reaction of the residual carbon and the oxygen is predominantly:

$$C+\tfrac{1}{2}O_2 \rightarrow CO \quad (1)$$

To a limited extent carbon dioxide is also produced in the reaction:

$$C+O_2 \rightarrow CO_2 \quad (2)$$

or $$CO+\tfrac{1}{2}O_2 \rightarrow CO_2 \quad (3)$$

The carbon monoxide is a fuel. The reactions of the steam and residual carbon are predominantly:

$$C+H_2O \rightarrow CO+H_2 \quad (4)$$

The steam and carbon monoxide also interact in the rection:

$$H_2O+CO \rightarrow H_2+CO_2 \quad (5)$$

The hydrogen and carbon monoxide are fuel gases. Reactions (1), (2) and (3) are exothermic; reactions (4) is endothermic. The generation of the fuel gases in endothermic reactions such as reaction (4) serve an important purpose in addition to their economic purpose. They absorb heat from the oxidation reaction and aid in maintaining the temperature of the gas which heats the raw shale so that it does not reach a magnitude at which the oil is cracked and suffers other undesired reactions.

In the practice of this invention, the combustion which takes place in accordance with the teachings of Burton and others is replaced by gasification. Gasification is defined as a process in which a carbonaceous substance is converted into a useful gaseous fuel. The word "gasifier" as used in this application means an apparatus or reactor in which gasification takes place. This invention combines pyrolyzing or liquefaction and gasification for producing fuel liquids and gases from Eastern shale. The gasification maximizes the production of gaseous fuels. The process according to this invention can be adjusted by the choice of pressures, temperatures, and reactor residence times to produce a range of the liquid and gaseous fuels from Eastern shale.

This invention is practiced in a two-stage fluidized-bed process. In the first stage (pyrolyzer) preheated shale is fluidized by and reacted with a synthesis gas comprising primarily $H_2$, CO, $H_2O$, and $CO_2$ at a temperature in the range 700° to 1200° F. and a pressure of 30 to 50 psig. The reactor temperature is selected to maximize shale oil yield; the pressure, to minimize the problems of feeding the shale and of processing the synthesis product gas. The reactor is sized to maintain good fluidization and to achieve the shale residence time needed to form the pyrolysis products. In the second stage (gasifier) residual carbon in the shale is used to generate the $H_2$, CO, $H_2O$ and $CO_2$ fuel gases. Oxygen (from an air separation plant) and steam combine to fluidize the pyrolyzed shale and gasify its carbon. The gasifier operates in the same pressure range as the pyrolyzer, but at a higher temperature (1400° to 1800° F.) in order to maintain a reasonable gasification rate (and gasifier size), and to provide the necessary sensible heat in the synthesis gas to meet pyrolyzer energy requirements. Additional heat is transferred from the gasifier to the pyrolyzer by the circulation of spent shale between the two stages. This additional heat permits the temperature in the pyrolyzer to be stabilized at the required level.

Sensible heat from the spent shale leaving the gasifier is used both to preheat oxygen and steam entering the gasifier, and to preheat the shale entering the pyrolyzer. To accomplish this a separate stream of gas can be circulated between two moving beds—one containing the raw shale and the other, the spent shale.

The vapor stream leaving the pyrolyzer is cooled to condense out the liquids. The shale oil collected has to be further upgraded to reduce its sulfur and nitrogen contents, increase its hydrogen content, and lower its viscosity and pour point. The condensed water can be returned to the gasifier. Gases leaving the condenser are collected to be used as a fuel, and/or as a feedstock for chemicals, synfuels, etc. A portion of the gas is recycled to the gasifier and to the gas loop which preheats the raw shale.

The fluidized bed reactors and the process configuration permit close control of process temperatures and residence times, so that high conversion efficiencies and effective energy utilization can be achieved while minimizing the undesirable secondary (shale oil cracking) reactions. The products generated are shale oil, light oil, synthesis gas (medium-Btu gas), ammonia, and sulfur.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

DESCRIPTION OF THE PREFERRED EMBODIMENTS

Figure 1:
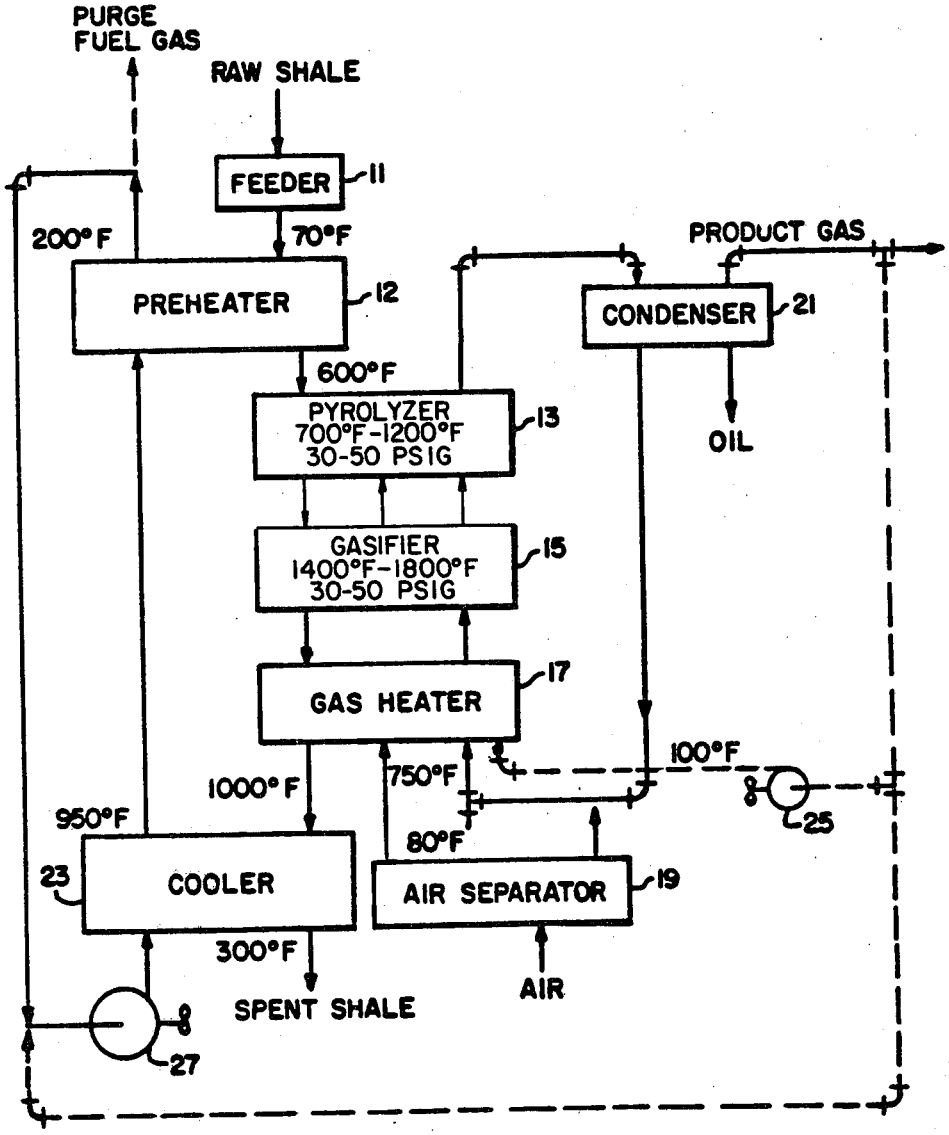
FIG. 1 is a block flow diagram illustrating the practice of this invention.

FIG. 1 shows typical temperatures of operation for the components of the system, and other data. This data are included only for the purpose of aiding those skilled in the art in practicing this invention and not with any intention of in any way limiting this invention.

The process according to this invention will now be described with reference to FIG. 1. Crushed and sized oil shale is supplied by feeder 11 to preheater 12. The largest dimension through a particle is typically equal to or less than about 174" but larger particles, for example, up to $\frac{3}{4}$" may be used. The raw shale is transported in a moving bed through the preheater 12; i.e., the shale crushed and sized moves as a stream or mass through the preheater, from its shale inlet to its shale outlet, typically under force of gravity. From the preheater 12, the raw shale moves into the pyrolyzer 13. Typically, the raw shale is fed into the bottom of the pyrolyzer. In the pyrolyzer 13, the mass of shale particles are formed into a fluidized bed by gas derived from gasifier 15. The kerogen of the shale is pyrolyzed in the pyrolyzer by heating, forming vapor and gaseous products. The pyrolyzed shale being lighter than the raw shale which is being fed in, rises to the top of the fluidized bed whence it is transferred to the gasifier 15. The gasifier 15 is supplied with hot oxygen and steam from a gas heater 17. The gas heater 17 is supplied with oxygen from an air separator 19. The oxygen is derived from air fed into the air separator. Alternatively, the air may be supplied directly to the gas heater. Water is also supplied to the gas heater. Some of the water may be derived from a condenser 21 where the liquid product derived from the pyrolyzer is condensed. The oxygen is heated and the water is converted into superheated steam by heat derived from hot spent shale supplied to the gas heater from the gasifier. This spent shale is substantially free of residual carbon. The residual carbon is consumed in the gasifier. The oxygen and steam from the gas heater 17 fluidizes the bed in the gasifier. In addition, these gases react with the residual carbon in the pyrolyzed shale to produce fuel gas or synthesis gas which includes hydrogen, carbon monoxide, steam and carbon dioxide and may also include small quantities of methane. The spent shale from the gas heater is fed into a cooler 23. It flows through the cooler 23 as a moving bed.

The heating of the raw shale in the pyrolyzer produces pyrolyzed kerogen, condensable and non-condensable fuel products which are supplied to the condenser 21. The light hydrocarbons and the hydrogen, carbon monoxide and carbon dioxide flow through an outlet where they are in part used in the process and in part collected for commercial or other uses. A portion of this gas is supplied to the gas heater through a fan 25 to serve in fluidizing the gasifier bed. A portion is supplied through fan 27 to extract heat from the spent shale moving bed in the cooler 23 and to supply the preheater 13 to preheat the raw shale. The cooled spent shale from the cooler 23 is disposed of.

Figure 2:
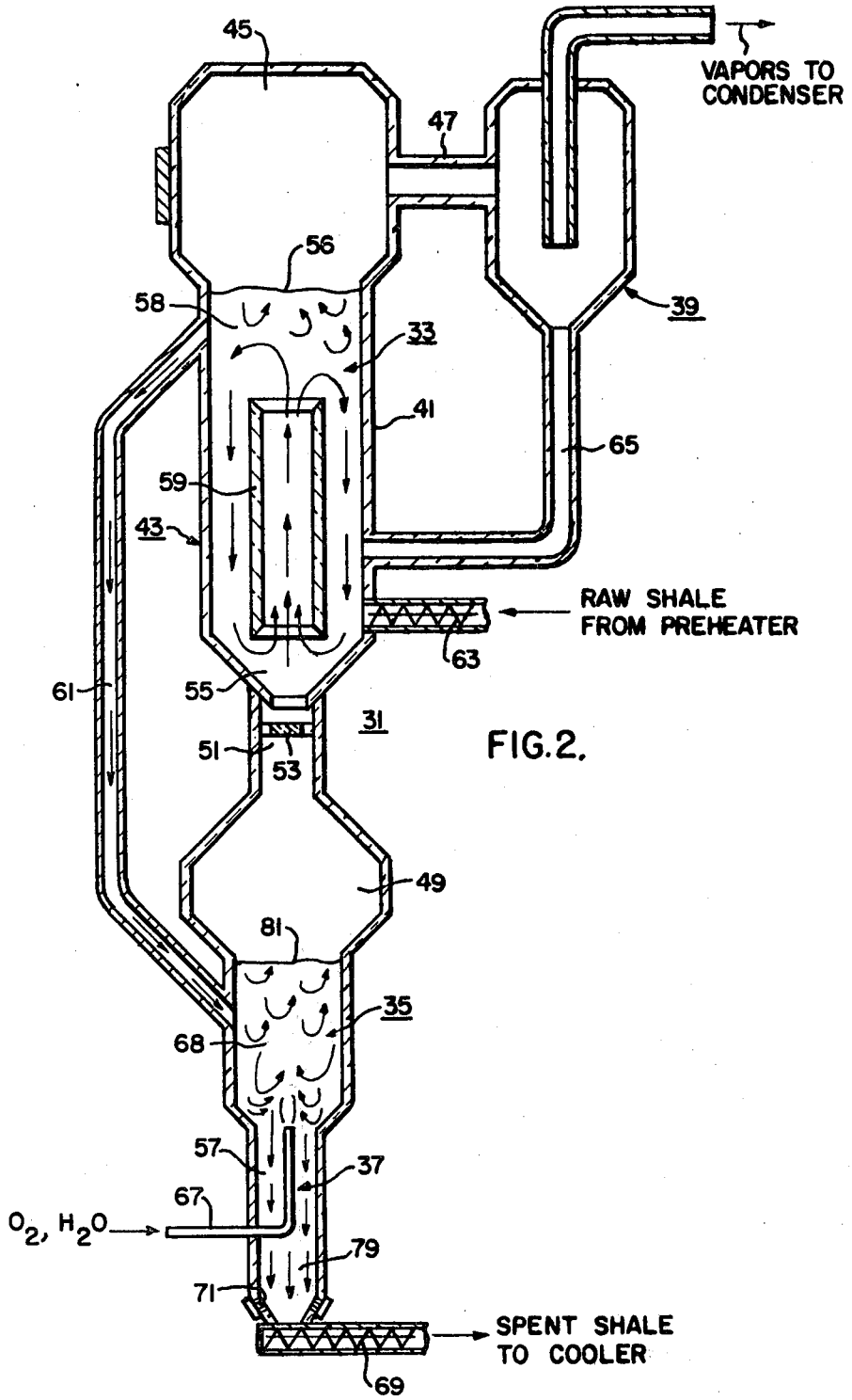
FIG. 2 is a view in longitudinal section, partly diagrammatic, of a retort in accordance with this invention, used in the practice of this invention.

FIG. 2 shows a two-stage fluidized-bed oil-shale pyrolysis oxygasification retort 31. The retort 31, shown in FIG. 2, essentially encompasses the components represented by the blocks 13, 15 and 17 of FIG. 1; namely a pyrolyzer or pyrolysis reactor 33, a gasifier 35 or oxygasification reactor and a moving-bed gas heater 37. The retort 31 also includes a cyclone 39. The cyclone 39 serves to separate shale particles swept out of the pyrolyzer 33 by the fuel gas and to return these particles to the pyrolizer. The retort 31 has an inner lining 41 of a refractory material capable of withstanding the temperatures at which the oil shale is pyrolyzed.

The retort 31 includes an elongated member 43 generally symmetrical about its central longitudinal axis, within which the oil shale is treated. The pyrolyzer 33 is contained in an upper chamber of the member 43 and the gasifier 35 in a lower chamber of this member. The pyrolyzer freeboard 45 is connected to the cyclone 39 through a channel 47. The gasifier 35 has a freeboard 49 which is of greater diameter than the gasifier bed section permitting a decrease in the flow velocity of the gases from the gasifier. The freeboard 49 is connected to the pyrolyzer 33 through a constricted passage of channel 51 within which a baffle 53 is centrally disposed. The channel 51 and baffle 53 operate as a Venturi causing the hot gas, containing shale particles, which passes to the pyrolyzer 33 from the gasifier 35 to move at a high speed. The baffle 53 inhibits downward flow of particles from the bottom of the pyrolyzer to the gasifier. The entrance 55 to the pyrolyzer from channel 51 tapers outwardly. At its bottom the gasifier 35 is in communication with a channel 57 through which the hot spent shale flows. Within the pyrolyzer 33 there is a ceramic tube 59. The ceramic tube 59 extends from the entrance 55 of the pyrolyzer to a point well below the top 56 of the fluid bed 58 in the pyrolyzer. The tube 59 conducts the gas from the pyrolyzer and the particles of shale which this gas entrains at a high speed. A channel 61 connects the upper region of the pyrolyzer 33 to the gasifier 35. Pyrolyzed shale which rises to the top of the fluidized bed 58 in the pyrolyzer is transferred through channel 61 for gasification in the gasifier. A screw feed 63 is connected near the bottom of the pyrolyzer for supplying raw shale from the preheater 12 (FIG. 1). This raw shale is fluidized by the gas from the gasifier 35 and flows into the tube 59. The shale moves with the gas at a high speed through the tube 59 and forms the fluidized bed 58. A channel 65 connects the cyclone 39 to the pyrolyzer above the screw feed 63. This channel returns to the pyrolyzer shale which is entrained by the gas leaving the pyrolyzer.

The hot spent shale from the gasifier 35 moves through exit channel 57 from the gasifier as a moving bed. An elbow 57 extends into channel 57. This elbow carries oxygen and water and opens into the gasifier. The hot shale in the moving bed 79 heats the oxygen and vaporizes the water. At the exit of the channel 57 there is a screw 69 for removing the spent shale to the cooler 23 (FIG. 1). Above the screw 69 there is a grate 71 through which oxygen and water are admitted. The oxygen and water are admitted both through elbow 67 and grate 71 because it is undesirable to concentrate all of the oxygen and water in a single stream through the moving beds 57 and 79. Such a stream would mix the spent shale in beds 57 and 79 with the pyrolyzed shale in fluidized bed 68. Part of the hot spent shale from the top of the bed 81 in the gasifier also flows upwardly into the pyrolyzer to supply heat to the shale in the pyrolyzer.

Figure 3:
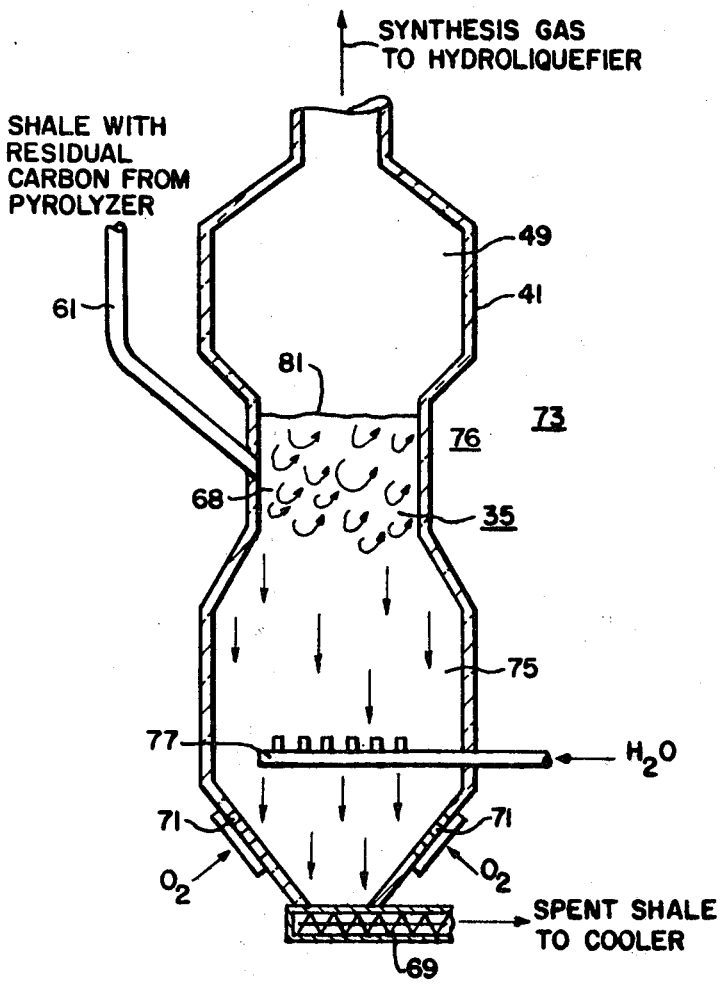
FIG. 3 is a fragmental view in longitudinal section, partly diagrammatic, of a retort in accordance with a modification of this invention, used in the practice of this invention.

FIG. 3 shows an alternate configuration for the gasifier and moving bed heater labelled 35 and 37, respectively, in FIG. 2. The upper portion of the retort 73, (which is not shown in FIG. 3) the pyrolyzer 33 and their associated components is the same as the retort 31 shown in FIG. 2. To the extent that components of FIG. 2 are shown in FIG. 3 corresponding parts are labelled the same. The exit channel 49 from the gasifier 76 shown in FIG. 3 is expanded. The water is injected into the moving bed of hot spent shale in this channel through a spray 77. The oxygen is injected through the grate 71 above the screw 69 which removes the spent shale to the cooler 23 (FIG. 1). The channel 75 is expanded above the grate 71 so that gas ($O_2$) velocity is at or below the minimum necessary for fluidation of the gasifier bed. With the configuration shown in FIG. 3, more heat may be recovered from the spent shale than with the modification shown in FIG. 2.

The operation of the reactor according to this invention will now be discussed in detail to aid those skilled in the art to practice this invention.

The shale supplied by the screw feeder 63 joins the general circulation of particles in the reactor: flowing rapidly upwardly in the central cylindrical ceramic draft tube 59 carried by typically 15 to 45 ft/sec of synthesis gas, and moving slowly downwardly in the annular area between the draft tube 59 and the refractory wall mobilized typically by 0.5 to 1.0 ft/sec of gas. The recirculating bed ensures well mixed particles, uniform in temperature. Raw shale is rapidly heated from the preheat temperature (about 600° F. typically) to the pyrolyzer operating temperature (about 1000° F. typically). Good contact between particles and the flowing gases is achieved. The oil vapors are rapidly removed from the reactor by the gases flowing to the condenser 21 (FIG. 1) or other liquid recovery unit. The pyrolyzed shale particles in the upper portion of the fluidized bed overflow to the gasifier 35. In the gasifier 35 the shale enters a bed 68 fluidized by oxygen and steam. At a temperature in the range typically of 1400° to 1800° F. these gases combine with the residual carbon of the shale to form a fuel gas containing $H_2$, CO, $H_2O$, $CO_2$, $CH_4$ which flows to the pyrolyzer 33. The mixture of oxygen and steam enters the gasifier 35 in two streams as shown in FIG. 2, one through the elbow 67 providing a reactant jet at the base of the fluidized section of the gasifier 35, the other through grates or distributors and a moving bed 79 of spent shale in the lower section of the gasifier. The oxygen-steam jet from elbow 67 stirs the fluidized bed and aids in maintaining a uniform temperature and a high reaction rate. The oxygen-water stream passing through the moving bed recovers heat from the spent shale and strips any remaining carbon from it.

In the operation of the pyrolysis and oxygasification reactors 33 and 35, a convenient operating pressure of between one and three atmospheres is established, and a shale feed rate is set. The operating temperature of the pyrolyzer is selected to maximize the yield of oil. This temperature is maintained by the sensible heat of gases and shale particulates flowing from the oxygasifier 35 to the pyrolyzer 33. Temperature control in the pyrolyzer is maintained by adjusting the oxygasifier gas temperature, the gas flow, and/or the shale-particle flow. Gas flow can be increased by the recycle of gases from the oil condenser 21 (FIG. 1) (or liquid recovery unit) through the oxygasifier to the pyrolyzer; shale particle flow can be increased by increasing the bed height 81 in oxygasifier, thus reducing the freeboard height. Particle flow from the oxygasifier 35 to the pyrolyzer 33 can be increased by increasing gas velocity in the oxygasifier and by reducing the freeboard diameter.

Adequate shale residence time must be provided in the pyrolyzer 33 to heat the shale and to drive off oil vapors and gases. This residence time can be adjusted by changing the bed volume 58 in the pyrolyzer.

Sufficient oxygen and water are fed to the oxygasifier 35 to consume the residual carbon present in the pyrolyzed shale. The operating temperature in the gasifier must be sufficiently high to achieve reasonable gasification rates. This temperature is adjusted by the steam-to-oxygen ratio in the feed stream. The bed volume 85 in the oxygasifier is established to allow the shale residence time necessary to complete the gasification of the residual carbon.

Studies and preliminary experiments have been conducted on this invention. The following Tables III and IV are based on these studies and experiments.

TABLE III

| | Raw Shale ◇1 | Spent Shale ◇2 | Shale Oil △1 | | Product Gas ①1 | |
|---|---|---|---|---|---|---|
| C. wt. % | 17.89 | 1.00 | 83.27 | $H_2$ | Mole % | 33.90 |
| H | 2.08 | 0.10 | 8.96 | $CH_4$ | | 4.44 |
| N | 0.63 | 0.30 | 2.03 | CO | | 50.80 |
| S | 2.48 | 1.00 | 2.20 | $CO_2$ | | 0.77 |

TABLE III-continued

| | Raw Shale ◇1 | Spent Shale ◇2 | Shale Oil △1 | | Product Gas ①1 | |
|---|---|---|---|---|---|---|
| O (By Diff.) | 2.07 | 0.00 | 3.44 | $C_2H_6$ | | 2.10 |
| Ash | 74.85 | 97.60 | 0.10 | $C_3H_8$ | | 0.48 |
| Total | 100.00 | 100.00 | 100.00 | $C_4H_{10}$ | | 0.80 |
| H/C Atomic Ratio | 1.40 | 1.20 | 1.29 | $C_5H_{12}$ | | 0.31 |
| Gravity, °API | | | 14.4 | $C_6H_{14}$ | | 0.13 |
| Estimated Heating Value/Btu/lb | 3640 | 240 | 18.393 | $C_6$+ | | 0.42 |
| | | | | $H_2S$, $H_2O$, $NH_3$, Misc. | | 5.85 |
| | | | | | | 100.00 |

TABLE IV

Two-Stage Fluidized Bed: Process Performance

| | T/D | Percent of Shale Organic Carbon Recovered |
|---|---|---|
| REACTANTS | | |
| Raw Shale* | 30,300 | |
| Oxygen | 2,505 | |
| Water (for gasif.) | 1,035 | |
| Total | 33,840 | |
| PRODUCTS | | |
| Shale Oil (11,294 bbl/D) | 1,914 | 29.9 |
| Product Gas**: | | |
| Light Oil ($C_2$+) | 584 | 9.3 |
| Fuel Gas (202, 786 scfm) | 7,524 | 55.6 |
| Spent Shale (includes shale fines) | 23,307 | 5.2 |
| Unaccounted | 1,036 | 0.0 |
| Total | 33,540 | 100.0 |

| ENERGY LOSSES | % Raw-Shale Thermal Energy Input |
|---|---|
| Unburned Carbon (spent shale) | 6.00 |
| Products (gas, liquid, solid) sensible and latent heat | 7.50 |
| Equipment heat losses | 1.50 |
| Total | 15.00 |
| RAW SHALE THERMAL ENERGY INPUT RECOVERED AS FUEL, % | 85.00 |

*30,000 T/D Shale retorted, 300 T/D shale fines disposed unutilized.
**Prior to gas cleanup - contains $H_2S$, $NH_3$, etc.

Table III shows the compositions of the raw shale, the spent shale, the oil and gases derived from the shale. Table IV shows typical reactants in tons per day used in the practice of this invention, the products derived, and the thermal energy losses.

Processing of 30,000 short tons per day of Sunbury shale (shale sample used in experimental studies in evaluating this invention) yields 11,294 bbl of shale oil. This accounts for 30% of the raw shale organic carbon processed. The product gas generated can be processed to recover light oil components, and a fuel gas. The light oil and fuel gas produced accounts for 9% and 50%, respectively, of the raw shale organic carbon. Thus, the process according to this invention can recover more than 90% of the raw shale organic carbon in the form of useful liquid and gaseous fuels.

The shale oil produced contains approximately 2 wt.% each of sulfur and nitrogen and may have to be upgraded to reduce the sulfur and nitrogen contents, to increase hydrogen content, and to improve its transport properties. This can best be accomplished via catalytic hydrotreatment as a separate step, independently of the retort operation.

Iron Co., and Kentucky Institute of Mining and Minerals for Buffalo Trace Area Development District, Kentucky, January 1981.) Comparisons of the process according to this invention and the Davy McKee evaluations are presented in the following Tables V and VI:

TABLE V

COMPARISON OF PROCESS CHARACTERISTICS

| | Paraho | Hytort | Two Stage Fluidized Bed |
|---|---|---|---|
| Reactor Types; Functions | •Moving Bed; Pyrolysis<br>•Moving Bed; Combustion | •Moving Bed; Hydropyrolysis<br>•Moving Bed; Hydrogasification | •Fluidized Bed; Pyrolysis<br>•Fluidized Bed; Gasification |
| Reaction Operating Conditions: | | | |
| Pressure, psig | 14.7–16.5 | ~550 | 30–50 |
| Shale Feed Particle Size, in × in | 3 × ⅜ | 3/2 × ⅜ | ≦¼ |
| Heat Balance Technique: | | | |
| Heat Source | Combustion of Residual C | Combustion of $H_2$—Rich Recycle Gas | Combustion of Residual C |
| Energy Utilization | Process Energy Requirement & Electric Power Gen. | Process Energy Requirements | Process Energy Requirements |
| Heat Transfer Technique | •Indirect Contact-Flue Gas to Fuel Gas; Flue Gas to $H_2O$<br>•Direct Contact-Flue Gas to Shale | •Direct Contact-Fuel Gas to Shale | •Direct Contact-Fuel Gas to Shale<br>•Solids Circulation |
| Spent Shale Sensible Heat Recovery | Air and Recycle Flue Gas Preheating | Oxygen and Recycle Fuel Gas Preheating | Oxidant, Recycle Fuel Gas and Raw Shale Preheating; Gas Circulation Between Spent Shale Cooler (moving bed) and Raw Shale Preheater |

TABLE VI

COMPARISON OF PROCESS EFFICIENCY

| | Paraho* | Hytort* | Two-stage Fluid-bed** |
|---|---|---|---|
| Processing steps | 1. Pyrolysis<br>2. Combustion of residual C | 1. Hydropyrolysis<br>2. Hydrogasification of residual C | 1. Pyrolysis<br>2. Steam gasification of residual C |
| Retort operating mode | Moving bed | Moving bed | Fluidized bed |
| Operating pressure, psig | 14.7–16.5 | ~550 | 30–50 |
| Ratio of retorted shale to mined shale | 0.893 | 0.8 | 0.99 |
| Percent of Mined Shale Organic Carbon (Shale Heating Value) Recovered as: | | | |
| Shale oil + Light oil | 35.5 (39.5) | 34.4 (36.9) | 39.2 (43.2) |
| High-Btu gas | 8.7 (13.2) | 0.0 (0.0) | 0.0 (0.0) |
| Medium-Btu gas | 0.0 (0.0) | 0.0 (0.0) | 52.7 (40.2) |
| Total | 44.2 (52.7) | 34.4 (36.9) | 91.9 (83.4) |
| Electricity | (7.4) | (−6.2) | (TBD) |

*Davy McKee Study - Fleming County, Kentucky Sunbury Shale Processing Plant (30,000 T/D)
**Estimated Tables II through IV are based on data from experiments in which the shale oil collected was very viscous. The liquid collection procedure consisted of washing the condenser as well as the connecting tubing downstream of the reactor with acetone, and then allowing the acetone to evaporate at ambient conditions. Some inefficiencies are involved: in collecting highly viscous liquids in small quantities (<10 ml) from a relatively large system (condenser, connecting lines, etc.), and in the circumstance that about 10 wt.% of raw shale organic carbon was not accounted in the experiments, the numbers presented in Table IV are therefore to be viewed as conservative estimates.

The so-called Paraho and Hytort processes have been used to recover oil from Sunbury Shale which is mined in Fleming County, Ky. These processes have been evaluated by Davy McKee Corp. (K. C. Vyas et al. Synthetic Fuels from Eastern Oil Shale. Final report prepared by Davy McKee Corp., the Cleveland-Cliffs The approach of this invention differs from the prior Paraho and Hytort processes in the following significant respects. The comments following each structural or operational statement described a feature of this invention:

Shale processing steps—pyrolysis plus oxygasification;

Reactor type—fluidized bed;

Heat and material exchange mode between process steps—direct gas and solids recirculation, without intermediate processing or heat exchange;

Reactor pressure—total pressure one to three atmospheres;

Liquid recovery mode—surface condensation in a condenser (alternatively direct condensation by a recycled, cooled oil product);

Heat recovery mode—heating of oxygen and steam reactants, heating of raw shale by separate gas recycle loop;

Shale oil upgrading mode—separate reduction of sulfur and nitrogen content (Reduction of viscosity is to be carried out as a separate operation independently of the pyrolysis/gasification operation.

As a result of these differences, significant advantages in Eastern oil shale processing can be gained in the practice of this invention by:

Fines utilization—fluidized beds process shale fines; the ratio of shale processed to that mined is high;

Fuel production—rapid shale-heating/product-removal and close temperature control maximizes liquid production; gasification produces useful medium-Btu gas from residual carbon;

Efficient operation—gas recycling and heat exchange involving recycle or product gas streams is minimized; energy losses are thus minimized;

Economic operation—high fuel yields, efficient operation and simple process configuration minimize capital and operating costs.

The fluidized bed process according to this invention allows reactor operation at low pressures which can accept most of the shale fines (minus $\frac{3}{8}$ inch). This allows less shale to be mined and disposed of per barrel of oil produced. The reactor can be operated at a pressure such that the light oil components ($C_3$ and $C_3+$) (hydrocarbons with 3 carbon atoms and with more than 3 carbon atoms) condense out along with the shale oil, thus avoiding the need to compress the gas for light oil recovery. The two-stage fluidized bed retort (FIGS. 1, 2) can be operated to maximize liquid yield by controlling the uniform temperature of reactors 33 and 35 as well as the products time-temperature history. Such control is difficult in moving bed operations.

The two-stage fluidized bed processing according to this invention can recover 39 wt.% or more of the organic carbon from Fleming County Sunbury shale as liquid fuel, and about 83% of the raw shale heating value as useful fuel (shale oil, light oil, medium-Btu gas).

While a preferred embodiment of this invention has been disclosed herein, many modifications thereof are feasible. This invention is not to be restricted except insofar as is necessitated by the spirit of the prior art.

We claim:

1. The method of recovering fuel from oil shale with apparatus including a pyrolyzer and a gasifier, wherein a stream of particles of raw shale is fed into the pyrolyzer and is to be heated in said pyrolyzer to thereby produce shale oil, product gas, including volatile compounds from said shale, and pyrolyzed shale containing residual carbon, the said method comprising supplying to said gasifier gas including oxygen and steam, transferring said pyrolyzed shale from said pyrolyzer to said gasifier, passing said gas in said gasifier through said pyrolyzed shale, to produce a fluidized bed of said pyrolyzed shale, reacting said oxygen and steam chemically with said pyrolyzed shale in said fluidized bed in said gasifier to produce hot fuel gas and hot spent shale, the quantity of oxygen supplied being substantially less than that required to react completely with said residual carbon contained in said pyrolyzed shale and the quantity of steam supplied being sufficient to react with substantially the remainder of said residual carbon whereby said fuel gas is produced, transmitting said hot fuel gas to said pyrolyzer, passing said hot fuel gas through said raw shale at the bottom of said fluidized bed to produce a fluidized bed of said raw shale, contacting said hot fuel gas with said raw shale in said fluidized bed in said pyrolyzer thermally to heat said raw shale, the heating of said raw shale by said hot fuel gas separating said oil and product gas from said raw shale, transmitting said product gas and fuel gas resulting from the reaction of the steam and oxygen with said residual carbon from said pyrolyzer to a facility for separating said product gas as a fuel, and collecting the oil separated from said raw shale.

2. The method of claim 1 wherein the oil separated from the raw shale in the pyrolyzer is vaporized and the vapor from said oil is condensed and collected.

3. The method of claim 1 wherein the raw shale is preheated before it is fed into the pyrolyzer, the said raw shale being preheated by heat derived from the spent shale and carried by fuel gas derived from the facility.

4. The method of claim 1 wherein the heat for preheating the oxygen in the gas containing the oxygen and the steam and the heat for producing the steam in said gas is at least in part derived from fuel gas transmitted from the facility.

5. The method of claim 1 including transmitting the hot spent shale from the gasifier to the pyrolyzer and contacting the said hot spent shale thermally with the raw shale in said pyrolyzer to heat said raw shale additionally, the said heating of said raw shale contributing to the separation of the oil and volatile compounds from said raw shale.

6. The method of recovering fuel from raw oil shale with apparatus including a pyrolyzer and a gasifier, wherein a stream of particled raw shale is fed into the pyrolyzer and is to be heated in aid pyrolyzer to thereby produce shale oil and product gas, including volatile compounds from said shale, and pyrolyzed shale containing carbon and wherein said pyrolyzed shale is thereafter to be transferred to said gasifier, the said method comprising supplying to said gasifier gas including oxygen and steam, passing said gas in said gasifier through said pyrolyzed shale to produce a fluidized bed of said pyrolyzed shale, said pyrolyzed shale including residual carbon, reacting said oxygen and steam chemically with said carbon in said pyrolyzed shale in said gasifier to produce hot fuel gas and hot spent shale, the quantities of oxygen and steam being so related that said residual carbon is efficiently converted into fuel gas, passing said hot gas through said raw shale to produce a fluidized bed of said raw shale in said pyrolyzer, transferring pyrolyzed shale from the region at or near the top of said fluidized bed of raw shale in said pyrolyzer to said gasifier as the pyrolyzed shale in said gasifier, reacting said hot fuel gas thermally with said raw shale in said fluidized bed in said pyrolyzer to heat said raw shale, transferring said hot spent shale together with said gas from said gasifier to said pyrolyzer through the region at or near the bottom of the fluidized bed of raw shale in said pyrolyzer to heat said raw shale additionally, the heating of said raw shale, by said hot fuel gas and by said hot pyrolyzed shale producing product gas and oil, transmitting said product gas from said pyrolyzer to a facility for utilizing said product gas, and collecting the oil separated from said raw shale.

7. The method of claim 1 wherein the reaction of the oxygen and the residual carbon is exothermic and the reaction of the steam and the remainder of the residual carbon is endothermic, the endothermic reaction absorbing heat from the exothermic reaction of the residual carbon and the oxygen to maintain the temperature of the raw shale below a magnitude at which the oil in the shale is cracked.

8. The method of claim 1 wherein the pyrolyzer is maintained at a temperature between 700° F. and 1200° F. and at a pressure between 30 psig and 50 psig and the gasifier is maintained at a temperature between 1400° F. and 1800° F. and at a pressure between 30 psig and 50 psig.

9. The method of claim 6 wherein the reaction of the oxygen and the residual carbon is exothermic and the reaction of the stream and the remainder of the residual carbon is endothermic, the endothermic reaction absorbing heat from the exothermic reaction of the residual carbon and the oxygen to maintain the temperature of the raw shale below a magnitude at which the oil in the shale is cracked.

10. The method of claim 6 wherein the pyrolyzer is maintained at a temperature between 700° F. and 1200° F. and at a pressure between 30 psig and 50 psig and the gasifier is maintained at a temperature between 1400° F. and 1800° F. and at a pressure between 30 psig and 50 psig.

* * * * *